US007608747B2

(12) United States Patent
Ramachandran et al.

(10) Patent No.: US 7,608,747 B2
(45) **Date of Patent: *Oct. 27, 2009**

(54) AROMATICS HYDROGENOLYSIS USING NOVEL MESOPOROUS CATALYST SYSTEM

(75) Inventors: Bala Ramachandran, Bethlehem, PA (US); Lawrence L. Murrell, South Plainfield, NJ (US); Martin Kraus, Worms (DE); Zhiping Shan, Austin, TX (US); Philip J. Angevine, Woodbury, NJ (US)

(73) Assignee: Lummus Technology Inc., Bloomfield, NJ (US)

( * ) Notice: Subject to any disclaimer, the term of this patent is extended or adjusted under 35 U.S.C. 154(b) by 861 days.

This patent is subject to a terminal disclaimer.

(21) Appl. No.: 11/234,619

(22) Filed: Sep. 23, 2005

(65) Prior Publication Data

US 2006/0014995 A1 Jan. 19, 2006

Related U.S. Application Data

(60) Continuation-in-part of application No. 11/108,452, filed on Apr. 18, 2005, now abandoned, which is a division of application No. 10/246,495, filed on Sep. 18, 2002, now Pat. No. 6,906,208, which is a continuation-in-part of application No. 09/995,227, filed on Nov. 27, 2001, now Pat. No. 6,762,143, which is a continuation-in-part of application No. 09/390,276, filed on Sep. 7, 1999, now Pat. No. 6,358,486.

(51) Int. Cl.
*C07C 5/29* (2006.01)
*C07C 5/31* (2006.01)

(52) U.S. Cl. ..... 585/700; 585/353; 585/476; 585/940; 208/137; 208/138

(58) Field of Classification Search ..... 585/700, 585/737, 940, 353, 476; 208/137, 138
See application file for complete search history.

(56) References Cited

U.S. PATENT DOCUMENTS

| | | | | |
|---|---|---|---|---|
| 3,959,174 | A | 5/1976 | Winyall et al. | |
| 5,057,296 | A | 10/1991 | Beck | |
| 5,098,684 | A | 3/1992 | Kresge et al. | |
| 5,102,643 | A | 4/1992 | Kresge et al. | |
| 5,108,725 | A | 4/1992 | Beck et al. | |
| 5,110,572 | A | 5/1992 | Calabro et al. | |
| 5,191,134 | A | 3/1993 | Le | |
| 5,191,148 | A | 3/1993 | Degnan et al. | |
| 5,264,203 | A | 11/1993 | Beck et al. | |
| 5,374,747 | A | 12/1994 | Saxton | |
| 5,539,710 | A | 7/1996 | Tokushuku et al. | |
| 5,622,684 | A | 4/1997 | Pinnavaia et al. | |
| 5,672,556 | A | 9/1997 | Pinnavaia et al. | |
| 5,707,917 | A | 1/1998 | Geus et al. | |
| 5,763,731 | A | 6/1998 | McVicker et al. | |
| 5,795,555 | A | 8/1998 | Alive et al. | |
| 5,811,599 | A | 9/1998 | Alive et al. | |
| 5,811,624 | A | 9/1998 | Hantzer et al. | |
| 5,849,258 | A | 12/1998 | Lujano et al. | |
| 5,853,566 | A | 12/1998 | Kraushaar-Czarnetzki et al. | |
| 5,948,683 | A | 9/1999 | Koermer et al. | |
| 5,951,962 | A | 9/1999 | Muller et al. | |
| 6,133,186 | A | 10/2000 | Gosselink et al. | |
| 6,241,876 | B1 | 6/2001 | Tsao et al. | |
| 6,309,998 | B1 | 10/2001 | Bowman et al. | |
| 6,589,905 | B1 | 7/2003 | Fischer et al. | |
| 6,623,626 | B2 | 9/2003 | Baird et al. | |
| 6,930,219 | B2 * | 8/2005 | Shan et al. | 585/533 |
| 2003/0017943 | A1 | 1/2003 | Shan et al. | |
| 2003/0236164 | A1 | 12/2003 | Fischer et al. | |

FOREIGN PATENT DOCUMENTS

| | | |
|---|---|---|
| EP | 0 814 058 | 4/1997 |
| EP | 0 985 636 | 9/1999 |
| EP | 1 134 189 | 3/2000 |
| WO | WO 00/15551 | 3/2000 |
| WO | WO 01/72635 | 10/2001 |
| WO | WO 02/40402 | 5/2002 |

OTHER PUBLICATIONS

Cabera, et al., "Surfactant Assisted Synthesis of Mesoporous Alumina Showing Continuously Adjustable Pore Sizes", advanced materials, (1999) 33 No. 5 pp. 279-381.

* cited by examiner

*Primary Examiner*—In Suk Bullock
(74) *Attorney, Agent, or Firm*—Dilworth & Barrese, LLP.

(57) ABSTRACT

A process for the selective ring opening of ring-containing hydrocarbons in a feed stream having at least 10% ring-containing hydrocarbons includes contacting the feed stream with a ring opening catalyst containing a metal or a mixture of metals active for the selective ring opening of the ring-containing hydrocarbons on a support material, wherein the support material is a non-crystalline, porous inorganic oxide or mixture of inorganic oxides having at least 97 volume percent interconnected mesopores based on micropores and mesopores, and wherein the ring-containing hydrocarbons have at least one $C_6$ ring and at least one substituent selected from the group consisting of fused 5- or 6-membered rings, alkyl, cycloalkyl and aryl groups.

24 Claims, No Drawings

AROMATICS HYDROGENOLYSIS USING NOVEL MESOPOROUS CATALYST SYSTEM

CROSS REFERENCE TO RELATED APPLICATIONS

The present application is a continuation in part of U.S. application Ser. No. 11/108,452 filed Apr. 18, 2005, now abandoned which is a divisional of U.S. application Ser. No. 10/246,495 filed Sep. 18, 2002 and now issued as U.S. Pat. No. 6,906,208, which is a continuation in part of U.S. application Ser. No. 09/995,227 filed Nov. 27, 2001 and now issued as U.S. Pat. No. 6,762,143, which is a continuation in part of U.S. application Ser. No. 09/390,276 filed Sep. 7, 1999 now issued as U.S. Pat. No. 6,358,486, the contents of all of said patents and applications being incorporated by reference herein.

BACKGROUND

1. Field of the Invention

The present invention relates to a process for the selective ring opening of aromatic compounds using a mesoporous catalyst system.

2. Background of the Art

Aromatic saturation and hydrocracking have been proven to be upgrading technologies for improvement of diesel fuel cetane quality. Unfortunately, aromatics saturation brings about a marginal improvement in cetane number and reduction of the density of distillate fuels. By hydrocracking naphthalenes and their alkyl homologues into the jet and naphtha boiling ranges, one achieves a net increase in high cetane value distillate components (e.g. alkyl cyclohexanes, alkyl benzenes, paraffins, and slightly branched paraffins). The primary debit for aromatics saturation is its limited cetane improvement and high hydrogen consumption per cetane barrel improvement. The primary debit for hydrocracking is its poor selectivity for retaining distillate and total liquid products at the expense of $C_3/C_4$ production.

It has been widely reported [e.g., McVicker et al., J. Catal., 210, 137 (2002)] that the anticipated U.S. environmental regulations will require diesel specification of specific gravities <0.85 and cetane numbers>45, and European diesel fuels will require cetane numbers of 55 or more. Aromatics saturation does improve the cetane number to some extent. However, selective ring opening ("SRO") of naphthenic molecules to alkylcyclohexanes, n-paraffins and slightly branched paraffins significantly improves the cetane number of the diesel fuel. In the SRO process, naphthenic rings are ideally opened to alkylcyclohexanes as well as straight and branched alkanes with only minor loss of molecular weight.

U.S. Pat. No. 5,763,731 to McVicker et al. is directed to a process for selectively opening naphthenic rings. A process is disclosed for selectively opening rings of ring compounds in a feed stream wherein at least about 50 wt % of the ring compounds in the feed stream are characterized as containing at least one $C_6$ ring having at least one substituent containing 3 or more carbon atoms, which substituents are selected from the group consisting of fused 5-membered rings; fused 6-membered rings; $C_3$ or greater alkyls, cycloalkyls; and aryl groups. This patent also claims a bifunctional catalyst system for this process, which is comprised of an effective amount of a metal selected from Ir, Ru, Rh or mixtures thereof, on a catalyst support and wherein the catalyst support contains an acidic function selected from the group of silica, silica-alumina or zeolite having a structure characteristic of faujasite structure with a high Si/M ratio (M is Al, Ga, B, Zn, Fe or Cr) above 30. The acidic function can be incorporated into the catalyst or be a separate catalyst. However, for such a high Si/M ratio, the faujasite must be post-treated after synthesis to remove most of the framework M component. McVicker et al. also teach that a controlled amount of acidity is used to isomerize the cyclo-$C_6$ components to cyclo-$C_5$ components, which then can be ring opened more easily. The control of acidity is an important factor in producing a selective ring opening catalyst as excessive acidity leads to cracking instead of hydrogenolysis (carbon-carbon bond cleavage).

U.S. Pat. No. 5,811,624 to Hantzer et al. discloses a process of selectively opening five- and six-membered rings without substantial cracking using a transition metal such as Mo and W supported on a carbide, nitride, oxycarbide, oxynitride or oxycarbonitride and a noble metal supported on the same support or a separate carrier. Hantzer et al. claim to have better selectivity towards ring opening without a decrease in carbon number, compared to the noble metal based systems as, for example, claimed in McVicker's patents.

U.S. Pat. No. 6,241,876 to Tsao et al. describes a process for selective ring opening wherein the catalyst consists of a large pore molecular sieve having a faujasite structure and an alpha acidity of less than one, preferably less than 0.3, and the noble metal is selected from group VIII of the periodic table. The very low acidity of their catalyst is regarded as an essential step to minimize ring opening yield losses due to cracking.

Furthermore, U.S. Pat. No. 6,623,626 to Baird et al. discloses a process for ring opening using a combination of two catalysts, wherein the first one is an isomerization catalyst with an oxide supported naphthene ring isomerization metal and the second one is a ring opening catalyst comprising iridium supported on an inorganic oxide. The two catalysts are stacked or physically mixed together. The authors claim an improved ring opening yield of the iridium based ring opening catalyst, when the $C_6$ rings are first isomerized to a $C_5$ ring by the isomerization catalyst. In contrast to U.S. Pat. No. 5,763,731, they describe an improved quality of the obtained ring opened product, as the fraction of linear, unbranched alkanes is increased.

So far, the prior art has always described either the use of zeolitic supports for the ring opening of naphthenic molecules or the use of bulk oxides like silica or alumina. The same is true for the isomerization of cyclohexane components to methylcyclopentane components. Therefore, the support materials had either a restricted access for large molecules (e.g., zeolitic support), resulting in diffusion limitations or had a lower surface area, as it is typical for the bulk oxides.

SUMMARY

A process is provided herein for the selective ring opening of ring-containing hydrocarbons in a feed stream having at least 10% ring-containing hydrocarbons. The process comprises contacting of the feed stream with a ring opening catalyst in the presence of hydrogen at a temperature of from about 100° C. to about 500° C. and at a total pressure of from 0 to about 3000 psig, wherein the ring-opening catalyst contains a metal or a mixture of metals active for the selective ring opening of the ring-containing hydrocarbons on a support material, wherein the support material is characterized by being a non-crystalline, porous inorganic oxide or mixture of inorganic oxides having at least 97 volume percent interconnected mesopores based on micropores and mesopores, and wherein the ring-containing hydrocarbons have at least one $C_6$ ring and at least 3 carbon atoms contained in one or more substituent attached to the $C_6$ ring, wherein the substituent is selected from the group consisting of fused 5- or 6-membered rings, alkyl, cycloalkyl and aryl groups.

We have found that the use of a novel mesoporous support material (TUD-1) for selective ring opening of naphthenic molecules can overcome the limitations described above with respect to the prior art by combining a mesoporous structure with interconnecting pores and high surface area. The described catalysts based on TUD-1 exhibit a higher activity and better selectivity compared to the prior art catalysts. The most important feature of the material is an interconnecting mesopore system, which is not found in regular oxides or other mesoporous support materials.

Furthermore, the described catalyst system allows for the incorporation of secondary catalytic functions as for example zeolites, as described in patent application U.S. Pat. No. 6,762,143, which is herein incorporated by reference. An important feature of TUD-1 is that the insertion and fine dispersion of nano-sized particles like zeolites can be achieved without major technical difficulties. Furthermore, the second component has high accessibility due to the mesoporous, interconnecting pore system. In addition, the special preparation route of TUD-1 allows for the production of mixed oxide phases that have tailored properties like acidity, pore size, surface area and pore volume.

DETAILED DESCRIPTION OF PREFERRED EMBODIMENT(S)

The present invention is practiced on feed streams containing ring compounds wherein at least 10% of the ring compounds contain at least one $C_6$ ring and 3 or more carbon atoms contained in one or more substituents attached to the ring, which substituents are selected from the group consisting of fused 5-membered or 6-membered rings, alkyl and cycloalkyl groups, and aryl groups. Specific nonlimiting examples of such compounds include alkylbenzenes (e.g., ethyltrimethylbenzene, tetramethylbenzene, methyldiethylbenzene, etc.), dicyclic fused rings (e.g. tetralin, methyltetralin, ethyltetralin, methyldecalin, ethyldecalin, etc.), indane, aryl groups (e.g. biphenyl, diphenylmethane, etc.), cycloalkyl groups (e.g., butylcyclohexane, diethylcyclohexane, methyldiethylcyclohexane, etc.).

Preferred feed streams on which the present invention is practiced include those containing such compounds, preferably those boiling in the distillate range (about 175° C. to 400° C.). Nonlimiting examples of such feedstocks include diesel fuels, jet fuels, and heating oils. Preferably, these feedstocks have been hydrotreated to reduce sulfur content to low levels, preferably less than 100 ppm, more preferably below 10 ppm. Other feed streams can also be treated in accordance with the present invention by the manipulation of catalyst and process conditions. Such other feed streams include chemical feedstocks, and lube streams.

The SRO process involves contacting the feed stream with the catalyst system described herein in the presence of hydrogen at a temperature of from about 100° C. to about 500° C., preferably from about 350° C. to 450° C., a total pressure of from 0 to about 3,000 psig, preferably from about 100 to 2,200 psig and a space velocity of from about 0.1 to about 10 LHSV, preferably from about 0.5 to 5 LHSV, and a hydrogen circulation gas rate of from about 200 to about 10,000 SCF/B, preferably from about 500 to 5,000 SCF/B. The SRO reaction can be conducted in a fixed bed reactor containing one or more beds of catalyst particles. The reaction may be conducted in a countercurrent or cocurrent mode, including trickle flow operation. Optionally, a reactor can also include catalyst beds for hydrodesulfurization, aromatics saturation, and/or sulfur sorption, as well as SRO.

The inventive process advantageously can impact the characteristics of these feedstocks by: (i) reducing number of ring structures in the product stream; and/or (ii) avoiding significant dealkylation of any pendant substituents on the ring which reduces the volume of product in a specified boiling range; and/or (iii) increasing volume swell by lowering the density of the product stream. It is also desirable to produce distillate fuels with cetane numbers in excess of about 40, preferably in excess of about 45, and more preferably in excess of about 50. The cetane number is directly related to the types of molecules that are found in the distillate fuel. For example, the cetane number of molecules within a class (e.g., normal paraffins) increases with the number of carbon atoms in the molecule. Further, molecular classes may be ranked in terms of their cetane number for a specific carbon number: normal paraffins have the highest cetane number, followed by normal olefins, followed by isoparaffins, and followed by monocyclic alkylnaphthenes. Aromatic molecules, particularly multi-ring aromatics, have the lowest cetane numbers.

For example, naphthalene has a cetane blending number of about 5-10; tetrahydronaphthalene (tetralin) about 15, decahydronaphthalene (decalin) about 35-38, butylcyclohexane about 58-62, and n-decane about 72-76. These cetane measurements are consistent with the trend for higher cetane value with increasing ring saturation and ring opening.

Further, the aromatics content of a distillate stream will vary depending on its source. For example, if the distillate stream is a product fraction from a crude distillation tower, then the stream will be relatively low in aromatics, particularly multi-ring aromatics, and have a relatively high cetane number. Distillate streams having relatively low cetane numbers generally are product fractions from a fluid catalytic cracker, on the other hand, have relatively high amounts of aromatics, particularly multi-ring aromatics. It is known by those having ordinary skill in the art that, at a constant boiling point, an increase in cetane number generally corresponds to an increase in API gravity. Consequently, it is highly desirable to reduce the number of rings by selective ring opening.

Three terms commonly used in the literature to describe the transformation of naphthenes to paraffins or to naphthenes containing fewer rings, are "hydrogenolysis", "hydrodecyclization", and "ring opening". Hydrogenolysis reactions are those in which there is cleavage of a carbon-carbon bond, with addition of hydrogen at each point of cleavage. Hydrodecyclization is more specific in that a cyclic structure is cleaved in a hydrogen environment. Such reactions occur in the hydrocracking of large organic molecules, with formation of fragments that react with hydrogen in the presence of a suitable catalyst and at relatively high temperatures. Such fragments are typically either molecules in which ring s have been cleaved, or are alkyl substituents which have been cleaved, or both. This results in products which contain fewer carbon atoms than the original molecule. This, of course, results in lower boiling products. The term "ring opening" generally can encompass hydrogenolysis or hydrodecyclization. However, for purposes of the present invention, the term "selective ring opening" means a high propensity for cleavage of a ring bond which results in product molecules having substantially the same number of carbon atoms and one less ring than the original molecule.

Hydrogenolysis, as described in the present invention, is a key pathway for ring opening. Hydrogenolysis of naphthenes can be essentially described by the following two reactions: (1) the breaking of endocyclic carbon-carbon bonds; and (2) the breaking of exocyclic carbon-carbon bonds. The breaking of an endocyclic bond, as in ring opening, leads to a paraffin of same carbon number for a one ring naphthene, or an alkylated naphthene of same number of carbon atoms containing one less ring for a multi-ring naphthene. The breaking of an exocyclic carbon-carbon bond, as in dealkylation, results in the loss of an alkyl substituent which produces a decrease of molecular weight by producing two molecules each of lower boiling points.

The SRO catalyst of the invention includes a catalytically active material supported on a matrix of non-crystalline, porous inorganic oxide or mixture of inorganic oxides, and having at least 97 volume percent interconnected mesopores based upon micropores and mesopores. The mesoporous support material, designated as TUD-1, is described more fully below.

In one embodiment the SRO catalyst includes a metal or a mixture of metals being active for the selective ring opening of the above-mentioned molecules. The metal is preferably selected from the group consisting of iridium, ruthenium, rhodium, palladium, and platinum. The preferred ring-opening metal is iridium. The support material is the non-crystalline, mesoporous inorganic oxide matrix TUD-1, wherein the preferred oxide is silica.

In another embodiment, the inventive ring opening catalyst as described above may be combined with an isomerization catalyst comprising a metal that is active for the isomerization of $C_6$ ring-containing components to a $C_5$-containing component, such as platinum or palladium, on the aforementioned non-crystalline, mesoporous inorganic oxide matrix TUD-1, wherein the preferred oxide is alumina. The composition weight percentage of isomerization metal catalyst can range from about 50% to 99% based upon combined isomerization metal and ring-opening metal amounts, wherein the ring-opening metal and isomerization metal are not the same. The SRO and isomerization catalysts can be prepared separately and then the catalysts particles physically mixed. Alternately, the SRO metal and isomerization metals can be dispersed together within the same support matrix. As yet another alternative, the reactor in which the SRO process is conducted can contain stacked catalyst beds wherein the ring-opening catalyst particles and the isomerization catalyst particles are in separate beds.

In yet another embodiment, the ring opening catalyst described above the active material includes an acidic functionality, preferably in the form of a zeolite that is dispersed in the inorganic mesoporous matrix. Combinations of TUD-1 with zeolite are disclosed in U.S. Pat. No. 6,762,143. Preferred zeolites for use in the catalyst of the invention include FAU, EMT, VFI, AET and CLO, or combinations thereof.

In yet another embodiment, the amount of metal in the above-mentioned catalysts is preferably in the range of 0.01 to 3 wt %, preferably from about 0.1% to about 2.0%.

The catalyst support material TUD-1 is a three dimensional mesoporous inorganic oxide material containing at least 97 volume percent interconnected mesopores (i.e., no more than 3 volume percent micropores) based on micropores and mesopores of the organic oxide material (i.e., without any zeolite incorporated therein), and generally at least 98 volume percent mesopores. A method for making a preferred porous silica-containing catalyst support is described in U.S. Pat. No. 6,358,486, which is herein incorporated by reference. The average mesopore size of the preferred catalyst as determined from $N_2$-porosimetry ranges from about 2 nm to about 25 nm. Generally, the mesoporous inorganic oxide is prepared by heating a mixture of (1) a precursor of the inorganic oxide in water, and (2) an organic templating agent that mixes well with the oxide precursor or the oxide species generated from the precursor, and preferably forms hydrogen bonds with it.

The starting material is generally an amorphous material and may be comprised of one or more inorganic oxides such as silicon oxide or aluminum oxide, with or without additional metal oxides. The silicon atoms may be replaced in part by metal atoms such as aluminum, titanium, vanadium, zirconium, gallium, manganese, zinc, chromium, molybdenum, nickel, cobalt and iron and the like. The additional metals may optionally be incorporated into the material prior to initiating the process for producing a structure that contains mesopores. Also, after preparation of the material, cations in the system may optionally be replaced with other ions such as those of an alkali metal (e.g., sodium, potassium, lithium, etc.).

The organic templating agent is preferably a glycol (a compound that includes two or more hydroxyl groups), such as glycerol, diethylene glycol, triethylene glycol, tetraethylene glycol, propylene glycol, and the like, or member(s) of the group consisting of triethanolamine, sulfolane, tetraethylene pentamine and diethylglycol dibenzoate.

The mesoporous catalyst support is a pseudo-crystalline material (i.e., no crystallinity is observed by presently available X-ray diffraction techniques). The X-ray diffraction pattern of the inorganic oxide material includes one peak in 2-theta between 0.5 degrees and 2.5 degrees based on an X-ray diffractometer with a Cu K alpha energy source. The wall thickness of the mesopores is preferably from about 3 nm to about 25 nm. The surface area of the catalyst support as determined by BET ($N_2$) preferably ranges from about 400 $m^2/g$ to about 1200 $m^2/g$. The catalyst pore volume preferably ranges from about 0.3 $cm^3/g$ to about 2.2 $cm^3/g$.

The content of zeolite in the catalyst can range from less than about 1% by weight to more than about 99% by weight, preferably from about 5% by weight to 90% by weight, more preferably from about 20% by weight to about 80% by weight. The catalyst with zeolite included preferably contains no more than about 5 volume percent of micropores.

More particularly, the method for making the catalyst includes suspending a zeolite in water. An inorganic oxide precursor is then added to the water and mixed. The inorganic oxide precursor can be a silicate such as tetraethyl orthosilicate (TEOS) or a source of aluminum such as aluminum isopropoxide. TEOS and aluminum isopropoxide are commercially available from known suppliers.

The pH of the solution is preferably kept above 7.0. Optionally, the aqueous solution can contain other metal ions such as those indicated above. After stirring, an organic templating agent which binds to the silica (or other inorganic oxide) species by hydrogen bonding is added and mixed into the aqueous solution. The organic templating agent helps form the mesopores during a pore-forming step, as discussed below. The organic templating agent should not be so hydrophobic so as to form a separate phase in the aqueous solution. The organic templating agent can be one or more compound as listed above. The organic templating agent is preferably added by dropwise addition with stirring to the aqueous inorganic oxide solution. After a period of time (e.g., from about 1 to 2 hours) the mixture forms a thick gel. The mixture is preferably stirred during this period of time to facilitate the mixing of the components. The solution preferably includes an alkanol, which can be added to the mixture and/or formed in-situ by the decomposition of the inorganic oxide precursor. For example, TEOS, upon heating, produces ethanol. Propanol may be produced by the decomposition of aluminum isopropoxide.

The gel is then aged at a temperature of from about 5° C. to about 45° C., preferably at room temperature, to complete the hydrolysis and poly-condensation of the inorganic oxide source. Aging preferably can take place for up to about 48 hours, generally from about 2 hours to 30 hours, more preferably from about 10 hours to 20 hours. After the aging step the gel is heated in air at about 98° C. to 100° C. for a period of time sufficient to dry the gel by driving off water (e.g., from about 6 to about 24 hours). Preferably, the organic templating agent, which helps form the mesopores, should remain in the gel during the drying stage. Accordingly, the preferred organic templating agent has a boiling point of at least about 150° C.

The dried material, which still contains the organic templating agent, is heated to a temperature at which there is a substantial formation of mesopores. The pore-forming step is conducted at a temperature above the boiling point of water and up to about the boiling point of the organic templating agent. Generally, the mesopore formation is carried out. at a temperature of from about 100° C. to about 250°, preferably from about 150° to about 200° C. The pore-forming step can optionally be performed hydrothermally in a sealed vessel at autogenous pressure. The size of the mesopores and volume of the mesopores in the final product are influenced by the length and temperature of the hydrothermal step. Generally, increasing the temperature and duration of the treatment increases the percentage of mesopore volume in the final product.

After the pore-forming step the catalyst material is calcined at a temperature of from about 300° C. to about 1000° C., preferably from about 400° C. to about 700° C., more preferably from about 500° C. to about 600° C., and maintained at the calcining temperature for a period of time sufficient to effect calcination of the material. The duration of the calcining step typically ranges from about 2 hours to about 40 hours, preferably 5 hours to 15 hours, depending, in part, upon the calcining temperature.

To prevent hot spots the temperature should be raised gradually. Preferably, the temperature of the catalyst material should be ramped up to the calcining temperature at a rate of from about 0.1° C./min. to about 25° C./min., more preferably from about 0.5° C./min. to about 15° C./min., and most preferably from about 1° C./min. to about 5° C./min.

During calcining the structure of the catalyst material is finally formed while the organic molecules are expelled from the material and decomposed.

The calcination process to remove organic templating agent can be replaced by extraction using organic solvents, e.g., ethanol. In this case the templating agent can be recovered for re-use.

Also, the catalyst powder of the present invention can be admixed with binders such as silica and/or alumina, and then formed into desired shapes (e.g., pellets, rings, etc.) by extrusion or other suitable methods.

Metal ions such as titanium vanadium, zirconium, gallium, manganese, zinc, nickel, iron, cobalt, chromium and molybdenum may be added to the catalyst by impregnation, ion exchange, or by replacing a part of the lattice atoms as described in G. W. Skeels and E. M. Flanigen in M. Occeri, et al., eds., A.C.S. Symposium Series, Vol. 398, Butterworth, pgs. 420-435 (1989).

Various features of the invention are illustrated by the Examples given below. Composition percentages or parts are by weight unless otherwise indicated.

EXAMPLE 1

A 0.47 wt % ruthenium/Si-TUD-1 was prepared from an incipient wetness of ruthenium (II) nitrosyl nitrate. 0.076 Parts by weight of the ruthenium salt was dissolved in 2.6 parts of ethanol. This solution was added to 5 parts of Si-TUD-1 with mixing. The powder was dried at 25° C.

For dispersion measurement using CO chemisorption, the powder was then reduced in a hydrogen stream at 100° C. for 1 h followed by a ramp to 350° C. at 5° C./min and maintained at this temperature for 2 h. Ambient temperature/pressure CO chemisorption was employed to calculate metal dispersion. A dispersion of 100% was measured for the metal assuming a Ru:CO stoichiometry of 1.

EXAMPLE 2

A 0.90 wt % iridium/Si-TUD-1 was prepared from an incipient wetness of iridium (III) chloride. 0.134 Parts of the iridium salt was dissolved in 5.2 parts of deionized water. This solution was added to 8 parts of Si-TUD-1 with mixing. The powder was dried at 25° C.

For dispersion measurement using CO chemisorption, the powder was then reduced in a hydrogen stream at 100° C. for 1 h followed by a ramp to 350° C. at 5° C./min and maintained at this temperature for 2 h. CO chemisorption showed a 75% dispersion for the metal assuming an Ir:CO stoichiometry of 1.

EXAMPLE 3

A 0.90 wt % platinum/Si-TUD-1 was prepared from an incipient wetness of tetraammine platinum (II) nitrate. 0.09 Parts of the platinum salt was dissolved in 4 parts of deionized water. This solution was added to 5 parts of Si-TUD-1 with mixing. The powder was dried at 25° C.

For dispersion measurement using CO chemisorption, the powder was then reduced in a hydrogen stream at 100° C. for 1 h followed by a ramp to 350° C. at 5° C./min and maintained at this temperature for 2 h. A dispersion of 61% was measured for the metal assuming a Pt:CO stoichiometry of 1.

EXAMPLE 4

A 0.45 wt % iridium/Si-TUD-1 was prepared from an incipient wetness of iridium (III) chloride. 0.042 Parts of the iridium salt was dissolved in 4 parts of deionized water. This solution was added to 5 parts of Si-TUD-1 with mixing. The powder was dried at 25° C. For dispersion measurement using CO chemisorption, the powder was then reduced in a hydrogen stream at 100° C. for 1 h followed by a ramp to 350° C. at 5° C./min and maintained at this temperature for 2 h. A dispersion of 77% was measured for the metal assuming an Ir:CO stoichiometry of 1.

EXAMPLE 5

A 1.8 wt % iridium/Si-TUD-1 was prepared from an incipient wetness of iridium (III) chloride. 0.169 Parts of the iridium salt was dissolved in 4.1 parts of deionized water. This solution was added to 5 parts of Si-TUD-1 with mixing. The powder was dried at 25° C. For dispersion measurement using CO chemisorption, the powder was then reduced in a hydrogen stream at 100° C. for 1 h followed by a ramp to 350° C. at 5° C./min and maintained at this temperature for 2 h. A dispersion of 68% was measured for the sample assuming an Ir:CO stoichiometry of 1.

EXAMPLE 6

A 0.46 wt % platinum/Si-TUD-1 was prepared from an incipient wetness of tetraammine platinum (II) nitrate. 0.046

Parts of the platinum salt was dissolved in 4.1 parts of deionized water. This solution was added to 5 parts of Si-TUD-1 with mixing. The powder was dried at 25° C. For dispersion measurement using CO chemisorption, the powder was then reduced in a hydrogen stream at 100° C. for 1 h followed by a ramp to 350° C. at 5° C./min and maintained at this temperature for 2 h. A dispersion of 72% was measured for the sample assuming a Pt:CO stoichiometry of 1.

EXAMPLE 7

21 Parts of Si-TUD-1 was suspended in deionized water. The pH of the solution was adjusted to 2.5 by adding nitric acid. The exchange was carried out for 5 h. The solution was then drained. The Si-TUD-1 was then washed 5 times with deionized water. This Si-TUD-1 was then placed in 600 parts of deionized water. The pH of this solution was adjusted to 9.5 using ammonium nitrate. This exchange was carried out for 1 h. During this exchange, ammonium nitrate was added as needed to maintain the pH at 9.5. After the exchange, the Si-TUD-1 was washed 5 times with deionized water. Si-TUD-1 was then dried at 25° C. A 0.50% palladium/Si-TUD-1 was prepared utilizing this acid/base-treated Si-TUD-1, from an incipient wetness of tetraammine palladium (II) nitrate. 0.071 Parts of the palladium salt was dissolved in 4.1 parts of deionized water. This solution was added to 5 parts of TUD-1 with mixing. The powder was dried at 25° C. The catalyst powder was then calcined in air at 350° C. for 2 h, using a ramping rate of 1° C./min.

For dispersion measurement using CO chemisorption, the calcined powder was then reduced in a hydrogen stream at 100° C. for 1 h followed by a ramp to 350° C. at 5° C./min and maintained at this temperature for 2 h. A dispersion of 96% was measured for the sample assuming a Pd:CO stoichiometry of 1.

EXAMPLE 8

A 0.25% palladium/Si-TUD-1 was prepared utilizing the acid/base-treated TUD-1 (Example 7), from an incipient wetness of tetraammine palladium (II) nitrate. 0.035 Parts of the palladium salt was dissolved in 3.9 parts of deionized water. This solution was added to 5 parts of TUD-1 with mixing. The powder was dried at 25° C. The catalyst powder was then calcined in air at 350° C. for 2 h, using a ramping rate of 1° C./min.

For dispersion measurement using CO chemisorption, the calcined powder was then reduced in a hydrogen stream at 100° C. for 1 h followed by a ramp to 350° C. at 5° C./min and maintained at this temperature for 2 h. A dispersion of 90% was measured for the sample assuming a Pd:CO stoichiometry of 1.

EXAMPLE 9

A 0.38 wt % palladium/0.23 wt % platinum/Si-TUD-1 catalyst was prepared as follows. A 0.38% palladium TUD-1 was prepared utilizing the acid/base-treated Si-TUD-1 (Example 7), from an incipient wetness of tetraammine palladium (II) nitrate. 0.053 Parts of the palladium salt was dissolved in 3.75 parts of deionized water. This solution was added to 5 parts of TUD-1 with mixing. The powder was dried at 25° C. The catalyst powder was then calcined in air at 350° C. for 2 h, using a ramping rate of 1° C./min.

A 0.23 wt % platinum impregnation on this catalyst was prepared from an incipient wetness of tetraammine platinum (II) nitrate. 0.018 Parts of the platinum salt was dissolved in 3.25 parts of deionized water. This solution was added to 4.02 parts of 0.38 wt % Pd/Si-TUD-1 with mixing. The powder was dried at 25° C.

For dispersion measurement using CO chemisorption, the powder was then reduced in a hydrogen stream at 100° C. for 1 h followed by a ramp to 350° C. at 5° C./min and maintained at this temperature for 2 h. A dispersion of 81% was measured for the sample assuming Pd:CO and Pt:CO stoichiometry of 1.

EXAMPLE 10

A 0.19 wt % palladium/0.11 wt % platinum/Si-TUD-1 catalyst was prepared as follows. A 0.19 wt % palladium/Si-TUD-1 was prepared utilizing the acid/base-treated Si-TUD-1 (Example 7), from an incipient wetness of tetraammine palladium (II) nitrate. 0.027 Parts of the palladium salt was dissolved in 3.5 parts of deionized water. This solution was added to 5 parts of Si-TUD-1 with mixing. The powder was dried at 25° C. The catalyst powder was then calcined in air at 350° C. for 2 h, using a ramping rate of 1° C./min.

A 0.11 wt % platinum impregnation on this catalyst was prepared from an incipient wetness of tetraammine platinum (II) nitrate. 0.009 Parts of the platinum salt was dissolved in 3.27 parts of deionized water. This solution was added to 4.05 parts of 0.19% Pd/Si-TUD-1 with mixing. The powder was dried at 25° C.

For dispersion measurement using CO chemisorption, the powder was then reduced in a hydrogen stream at 100° C. for 1 h followed by a ramp to 350° C. at 5° C./min and maintained at this temperature for 2 h. A dispersion of 54% was measured for the sample assuming Pd:CO and Pt:CO stoichiometry of 1.

EXAMPLE 11

A silica TUD-1 catalyst containing 0.9% iridium was tested for the selective ring opening of decalin. The reaction was carried out at 300° C. and a pressure of 31 bars and WHSV of 0.5 $h^{-1}$. A decalin conversion of 76% was observed. The total ring opening yield was 60.7%. The ring opening yield is defined as, $$\text{Yield } i = M_i/M_f \times 100\ (\%)$$

$M_i$=mols of ring opening product $M_f$=mols of feed (decalin)

Total ring opening yield is defined as the sum of all the ring open product yields.

COMPARATIVE EXAMPLE 12

This Comparative Example does not illustrate the invention but is provided for comparison purposes. A silica gel with a surface area of 500 $m^2/g$ containing 0.9% iridium was tested for the selective ring opening of decalin. The reaction was carried out at 300° C. and a pressure of 31 bars and a WHSV of 0.5 $h^{-1}$. A decalin conversion of 83% was observed. The total ring opening yield was 56.5%.

While the above description contains many specifics, these specifics should not be construed as limitations of the invention, but merely as exemplifications of preferred embodiments thereof. Those skilled in the art will envision many other embodiments within the scope and spirit of the invention as defined by the claims appended hereto.

What is claimed is:

1. A process for the selective ring opening of ring-containing hydrocarbons in a feed stream containing at least about 10% by weight of at least one ring-containing hydrocarbon, said process comprising:

contacting the feed stream in a reaction zone with a ring opening catalyst in the presence of hydrogen under selective ring opening reaction conditions, wherein the ring opening catalyst contains at least one metal active for the selective ring opening of the ring-containing hydrocarbon on a first support material, wherein the first support material includes a noncrystalline, porous inorganic oxide or mixture of inorganic oxides having at least 97 volume percent of interconnected mesopores based on micropores and mesopores and having an X-ray diffraction pattern including one peak in 2-theta between 0.5 degrees and 2.5 degrees, and wherein said at least one ring-containing hydrocarbon has at least one $C_6$ ring and at least 3 carbon atoms contained in one or more substituents attached to the $C_6$ ring wherein the substituents are selected from the groups consisting fused 5-membered or 6-membered rings, alkyl, cycloalkyl and aryl groups.

2. The process of claim 1 wherein the reaction conditions include a temperature of from about 100° C. to about 500° C., a total pressure of from 0 to about 3,000 psig, and a space velocity of from about 0.1 to about 10 LHSV.

3. The process of claim 1 wherein the reaction conditions include a temperature of from about 350° C. to about 450° C., a total pressure of from about 100 to about 2,200 psig and a space velocity of from about 0.5 to about 5.0 LHSV.

4. The process of claim 1 wherein the inorganic oxide of the first support material is silica.

5. The process of claim 1 wherein the metal is selected from the group consisting of iridium, ruthenium, rhodium, palladium and platinum.

6. The process of claim 1 wherein the amount of metal in the catalyst ranges from about 0.01% to about 3.0% by weight based upon total catalyst weight.

7. The process of claim 1 wherein the amount of metal in the catalyst ranges from about 0.1% to about 2.0% by weight based upon total catalyst weight.

8. The process of claim 1 wherein the feed stream contains at least 50% by weight of ring-containing compounds.

9. The process of claim 1 wherein the ring containing hydrocarbon includes at least one compound selected from the group consisting of ethyltrimethylbenzene, tetramethyl benzene, methyl diethylbenzene, tetralin, methyltetralin, ethyltetralin, decalin, methyldecalin, ethyldecalin, indane, biphenyl, diphenylmethane, butylcyclohexane, diethylcyclohexane and methyldiethylcyclohexane.

10. The process of claim 1 wherein the process further includes contacting the feed stream in the reaction zone with an isomerization catalyst, said isomerization catalyst including at least one isomerization-active metal for the isomerization of the at least one $C_6$ ring-containing hydrocarbon to a $C_5$-containing component, wherein the isomerization-active metal is supported on a second support material including one or more noncrystalline, porous inorganic oxide having at least 97 volume percent of interconnected mesopores based on micropores and mesopores and having an x-ray diffraction pattern including one peak in 2-theta between 0.5 degrees and 2.5 degrees.

11. The process of claim 10 wherein the isomerization active metal is palladium or platinum.

12. The process of claim 10 wherein the inorganic oxide of the second support material is alumina.

13. The process of claim 10 wherein the reaction zone includes first and second catalyst beds and the ring opening catalyst is in the first catalyst bed and the isomerization catalyst is in the second catalyst bed.

14. The process of claim 10 wherein the ring opening catalyst and the isomerization catalyst are mixed together in a single catalyst bed.

15. The process of claim 10 wherein the weight ratio of the isomerization catalyst to the ring opening catalyst ranges from about 50 to about 99 percent isomerization catalyst to about 50 to about 1 percent ring opening catalyst.

16. The process of claim 1 wherein the ring opening catalyst includes an acidic component.

17. The process of claim 16 wherein the acidic component is a zeolite dispersed in the inorganic oxide support material.

18. The process of claim 17 wherein the amount of zeolite is from about 0.01 weight percent to about 10 weight percent based upon the total catalyst weight.

19. The process of claim 17 wherein the zeolite is selected from the group consisting of FAU, EMT, VFI, AET, CLO and mixtures thereof.

20. The process of claim 1 wherein the metal is selected from the group consisting of iridium, ruthenium, rhodium, platinum and palladium, the inorganic oxide is silica, the catalyst includes a binder selected from silica and alumina and is formed into a predetermined shape, and the reaction conditions include a temperature of from about 100° C. to about 500° C., a total pressure of from about 0 to about 3,000 psig, and a space velocity of from about 0.1 to about 10 LHSV.

21. A process for the selective ring opening of ring-containing hydrocarbons in a distillate feed stream containing at least about 10% by weight of at least one ring-containing hydrocarbon, said process comprising:

contacting the feed stream in a reaction zone with a ring opening catalyst under superatmospheric hydrogen pressure and a temperature range of 300° C. to 450° C., wherein the ring opening catalyst contains at least one noble metal supported on a noncrystalline, porous inorganic oxide or mixture of inorganic oxides having at least 97 volume percent of interconnected mesopores based on micropores and mesopores and having an X-ray diffraction pattern including one peak in 2-theta between 0.5 degrees and 2.5 degrees, the catalyst includes a binder selected from silica and alumina and is formed into a predetermined shape, and wherein said at least one ring-containing hydrocarbon has at least one $C_6$ ring and at least 3 carbon atoms contained in one or more substituents attached to the $C_6$ ring wherein the substituents are selected from the groups consisting of fused 5-membered or 6-membered rings, alkyl, cycloalkyl and aryl groups.

22. The process of claim 21 wherein the distillate feed stream contains at least 20% by weight of the at least one ring-containing hydrocarbon.

23. A process for the selective ring opening of ring-containing hydrocarbons in a distillate feed stream containing at least about 10% by weight of at least one ring-containing hydrocarbon, said process comprising:

contacting the feed stream in a reaction zone with a ring opening catalyst under superatmospheric hydrogen pressure and a temperature range of 300° C. to 450° C., wherein the ring opening catalyst contains iridium metal supported on a noncrystalline, porous silicon oxide having at least 97 volume percent of interconnected mesopores based on micropores and mesopores and having an X-ray diffraction pattern including one peak in 2-theta between 0.5 degrees and 2.5 degrees, the catalyst includes a binder selected from silica and alumina and is formed into a predetermined shape, and wherein said at least one ring-containing hydrocarbon has at least one $C_6$ ring and at least 3 carbon atoms contained in one or more substituents attached to the $C_6$ ring wherein the substituents are selected from the groups consisting of fused 5-membered or 6-membered rings, alkyl, cycloalkyl and aryl groups.

24. The process of claim 23 wherein the distillate feed stream contains at least about 20% by weight of the at least one ring-containing hydrocarbon.

* * * * *